US010811787B1

(12) United States Patent
West et al.

(10) Patent No.: US 10,811,787 B1
(45) Date of Patent: Oct. 20, 2020

(54) SYSTEMS AND METHODS FOR WAVELENGTH SCALED ARRAY LAYOUT OPTIMIZATION

(71) Applicant: Rockwell Collins, Inc., Cedar Rapids, IA (US)

(72) Inventors: James B. West, Cedar Rapids, IA (US); Aimee M. Matland, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 272 days.

(21) Appl. No.: 15/970,781

(22) Filed: May 3, 2018

(51) Int. Cl.

| | |
|---|---|
| ***H01Q 25/00*** | (2006.01) |
| ***H01Q 21/30*** | (2006.01) |
| ***H01Q 21/08*** | (2006.01) |
| ***H01Q 5/307*** | (2015.01) |

(52) U.S. Cl.
CPC ..... *H01Q 25/002* (2013.01); *H01Q 5/307* (2015.01); *H01Q 21/08* (2013.01); *H01Q 21/30* (2013.01)

(58) Field of Classification Search
CPC ..... H01Q 25/002; H01Q 5/307; H01Q 21/08; H01Q 25/00; H01Q 21/30; H01Q 3/42; H01Q 3/22; H01Q 3/34; G01S 1/02
USPC ..... 342/371
See application file for complete search history.

(56) References Cited

U.S. PATENT DOCUMENTS 7,034,753 B1 4/2006 Elsallal et al.
2002/0171601 A1* 11/2002 Puente Baliarda .... H01Q 1/246 343/893
2016/0315386 A1* 10/2016 Klemes ..... H01Q 3/40

OTHER PUBLICATIONS

Balanis, Constantine, Antenna Theory Analysis and Design, 2nd Ed., John Wiley and Sons, 1997, Section 11.4, Log-Period Antennas, pp. 551-566.
Breakall, J.K., "Introduction to the Three-Dimensional Frequency-Independent Phased-Array (3D-FIPA), A New Class of Phased Array Design", IEEE, 1992. 4 pages.
Cantrell et al., "Wideband Array Antenna Concept", IEEE Aerospace and Electronic Systems Magazine, vol. 21, No. 1, Jan. 2006, pp. 9-12.
Haupt, Randy L., "Antenna Arrays—A Computational Approach", John Wiley & Sons, 2010, pp. 177. 9 pages.

(Continued)

*Primary Examiner* — Harry K Liu
(74) *Attorney, Agent, or Firm* — Suiter Swantz pc llo

(57) ABSTRACT

An electronically scanned antenna array (ESA) includes a first band including first antennas and a second band including second antennas. Each first antenna operates over a first frequency bandwidth from a first frequency to a second frequency. At least two adjacent first antennas are spaced from one another by a first value of a wavelength scale parameter that corresponds to the second frequency. Each second antenna operates over a second frequency bandwidth from the first frequency to a third frequency greater than the first and less than the second frequency. At least two adjacent second antennas are spaced from one another by a second value of the wavelength scale parameter that corresponds to the third frequency. A second subset of the plurality of second antennas is adjacent to a first subset of the plurality of first antennas and spaced from the first subset based on the wavelength scale parameter.

20 Claims, 10 Drawing Sheets

(56) References Cited

OTHER PUBLICATIONS

Holland et al., "A Wavelength Scaled Array of Doubly-Mirrored Balanced Antipodal Vivaldi Antennas (DM-BAVAs)", IEEE, 2009. 4 pages.
Kindt et al., "A Wavelength-Scaled Ultra-Wide Bandwidth Array", IEEE Antennas Propagation Symp., Jun. 2009. 4 pages.
Kindt et al., "Analysis of a Wavelength-Scaled Array (WSA) Architecture", IEEE Transactions on Antennas and Propagation, vol. 58, No. 9, Sep. 2010, pp. 2866-2874.
Kindt et al., "Ultrawideband All-Metal Flared-Notch Array Radiator", IEEE Transactions and Antennas and Propagation, vol. 58, No. 11, Nov. 2010. pp. 3568-3575.
Kindt et al., "Wavelength-Scaled Ultra-Wide Bandwidth Multi-Function Phased Arrays", IEEE International Conference on Wireless Information Technology and Systems, 2010. 4 pages.
Kindt, Rick W., "Prototype Design of a Modular Ultrawideband Wavelength-Scaled Array of Flared Notches", IEEE Transactions on Antennas and Propagation, vol. 60, No. 3, Mar. 2012. 9 pages.
Lee et al., "Planar Ultrawideband Modular Antenna (PUMA) Wavelength-Scaled Array", IEEE AP-S, 2016. pp. 435-436.
Lo, Y.T., "A Mathematical Theory of Antenna Arrays with Randomly Spaced Elements", IDDD Transactions on Antennas and Propagation 12.3, 1964. pp. 257-268.
Mailloux, Robert, Phased Array Antenna Handbook, Ch. 6, vol. 2. Boston: Artech House, 2005. 63 pages.
Mayes, P.E., "Frequency-Independent Antennas and Broad-Band Derivatives Thereof", Proc. of the IEEE, vol. 80, No. 1, Jan. 1992. 10 pages.
Mital et al., "Wideband Multifunction Array Architectures using Wavelength-Scaled Radiating Elements", U.S. Naval Research Lab, 2013 IEEE International Symposium on Phased Array Systems and Technology. pp. 588-592.
Rumsey, Victor H., "Frequency Independent Antennas, Ch. 2 Basic Features of Frequency-Independent Antennas", Academic Press 1966. 11 pages.
Skolnik et al., "Dynamic programming applied to unequally spaced arrays", IEEE Transactions on Antennas and Propagation, 12.1, 1964. pp. 35-43.
Tripp et al., "Frequency-Independent Geometry for a Two-Dimensional Phased Array", IEE Antennas and Propagation Society International Symposium Transmitting Waves of Progress to the Next Millennium,, 2000 Digest. 2000, vol. 2. pp. 628-631.
Tripp, V.K., "The Spiral-Mode Microstrip Antenna—Broad Bandwidth and Low Profile", Proceedings of International Symposium on Electromagnetic Compatibility, Atlanta, Ga., 1995. pp. 108-113.

* cited by examiner

300

400b

400a

600a

600b

700

800

900

SYSTEMS AND METHODS FOR WAVELENGTH SCALED ARRAY LAYOUT OPTIMIZATION

BACKGROUND

The inventive concepts disclosed herein relate generally to the field of antenna arrays. More particularly, embodiments of the inventive concepts disclosed herein relate to systems and methods for wavelength scaled array layout optimization.

In existing antenna systems, it may be desirable to achieve near frequency independence and extremely wideband antenna performance. Linear log periodic structures may realize a near constant moderate gain and beamwidth over wide frequency ranges, but may have the disadvantages of only moderate gain and wide beamwidths. In addition, existing, uniformly sampled systems require high element counts for a given aperture size in order to operate at both a lowest and highest frequency, an issue which can be exacerbated when the uniformly sampled systems are intended to be used for wideband operation.

SUMMARY

In one aspect, the inventive concepts disclosed herein are directed to an electronically scanned antenna array (ESA). The ESA includes a first band including a plurality of first antennas. Each first antenna is configured to operate over a first frequency bandwidth from a first frequency to a second frequency. The first frequency is less than the second frequency. At least two adjacent first antennas spaced from one another by a first value of a wavelength scale parameter. The first value corresponds to the second frequency. The ESA also includes a second band including a plurality of second antennas. Each second antenna is configured to operate over a second frequency bandwidth from the first frequency to a third frequency. The third frequency is greater than the first frequency and less than the second frequency. At least two adjacent second antennas are spaced from one another by a second value of the wavelength scale parameter. The second value corresponds to the third frequency. At least a second subset of the plurality of second antennas is adjacent to at least a first subset of the plurality of first antennas. The second subset is spaced from corresponding first antennas of the first subset based on the wavelength scale parameter.

In a further aspect, the inventive concepts disclosed herein are directed to a method of designing an ESA. The method includes defining a bandwidth from a first frequency to a second frequency. The method includes generating a plurality of design frequencies including the first frequency and the second frequency. A ratio of each design frequency to at least one of a lower design frequency or a higher design frequency corresponds to a wavelength scale parameter. The method includes, for each design frequency, providing an array of antennas configured to operate at the corresponding design frequency. Each antenna within each array is spaced from adjacent antennas within the each array by a half wave spacing, and at least two adjacent antennas of each array are spaced from one another based on the wavelength scale parameter.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
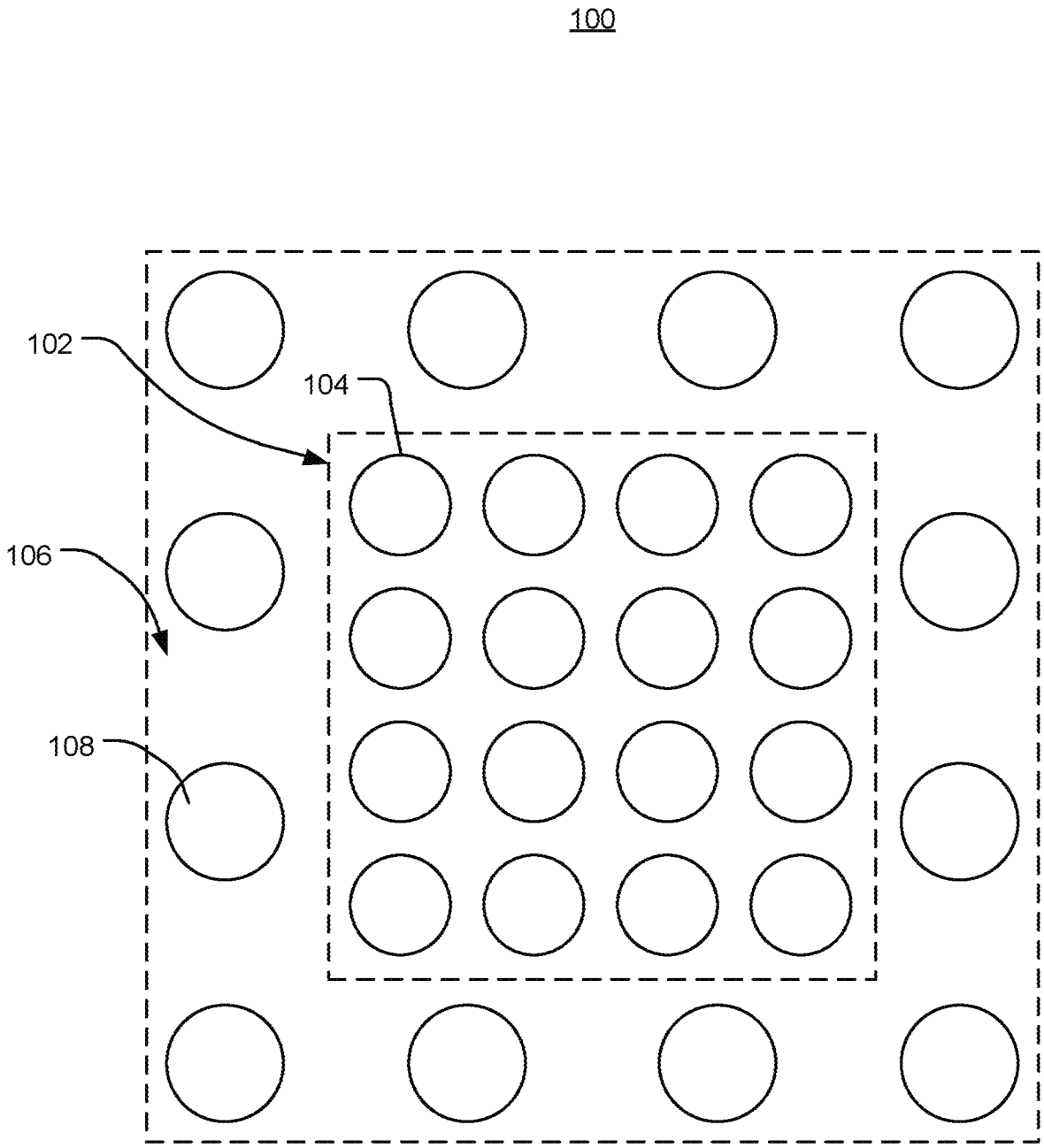
FIG. 1 is a schematic diagram of an exemplary embodiment of a rectangular ESA having two bands according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to an electronically scanned antenna array (ESA). In some embodiments, the ESA includes a first band including a plurality of first antennas. Each first antenna is configured to operate over a first frequency bandwidth from a first frequency to a second frequency. The first frequency is less than the second frequency. At least two adjacent first antennas spaced from one another by a first value of a wavelength scale parameter. The first value corresponds to the second frequency. The ESA also includes a second band including a plurality of second antennas. Each second antenna is configured to operate over a second frequency bandwidth from the first frequency to a third frequency. The third frequency is greater than the first frequency and less than the second frequency. At least two adjacent second antennas are spaced from one another by a second value of the wavelength scale parameter. The second value corresponds to the third frequency. At least a second subset of the plurality of second antennas is adjacent to at least a first subset of the plurality of first antennas. The second subset is spaced from corresponding first antennas of the first subset based on the wavelength scale parameter.

The ESA can improve upon existing systems by reducing the number antennas needed to achieve desired operational specifications or performance over a desired bandwidth, which can reduce power consumption, expedite manufacturing, and improve reliability of the operation of the ESA. As will be described herein, the ESA can be used in both planar, rectangular implementations as well as arbitrarily contoured (e.g., non-rectangular) and conformal (e.g., three-dimensional) implementations. The ESA can maintain more consistent gain, beam width, and sidelobe level over a broad bandwidth as compared to a uniformly illuminated structure.

Referring now to FIG. 1, an embodiment of an ESA 100 according to the inventive concepts disclosed herein includes a first band 102 including a plurality of first antennas 104 and a second band 106 including a plurality of second antennas 108. Each first antenna 104 is configured to operate over a first frequency bandwidth from a first frequency to a second frequency, inclusive. The first frequency is less than the second frequency. Operating over the first frequency bandwidth can including both receiving and transmitting at any frequency greater than or equal to the first frequency and less than or equal to the second frequency. In some embodiments, the second frequency is highest frequency of operation of the ESA 100. Each first antenna 104 can have a size (e.g., diameter or other maximum extent across the first antenna 104) on the scale of approximately $10^{-3}$ m to $10^{-2}$ m.

As shown in FIG. 1, the ESA 100 is formed as a rectangular array with each band based on a four by four arrangement of antennas. It will be appreciated that the various ESAs described herein, including the ESA 100, may include varying arrangements of antennas (e.g., two-by-two; three-by-four; the second band 106 may include multiple adjacent arrays such that the second band 106 would include twenty-four antennas 108 rather than the illustrated twelve antennas 108). The ESA 100 can be formed by providing the second band 106, removing interior members from the second band 106 (those which are not shown in FIG. 1), and overlaying the first band 102 on the second band 106.

In some embodiments, the spacing of the antennas of the ESA 100 corresponds to a wavelength scale parameter. The wavelength scale parameter may be indicative of a lattice relaxation factor indicating relaxation of antenna spacing (or relaxation of antenna spacing constraints). The wavelength scale parameter can indicate a density of the antennas of each band of the ESA 100 as a function of position. For example, at least two adjacent first antennas 104 of the first band 102 can be spaced from one another by a first value of the lattice relation factor, where the first value corresponds to the second frequency. Similarly, at least two adjacent antennas 108 of the second band 106 can be spaced from one another by a second value of the wavelength scale parameter, where the second value corresponds to the third frequency. As illustrated in the various ESAs described herein, including the ESA 100, the spacing within bands can change in value from relatively inward bands (e.g., band 102) to relatively outward bands (e.g., band 106). In some embodiments, the antennas of each band have a half-wavelength spacing (e.g., the spacing amongst the antennas 104 of the first band 102 is a half-wavelength, where the wavelength corresponds to the first frequency i.e. wavelength=c/first frequency, where c=speed of light). It will be appreciated a wavelength scaled array is not uniformly distributed, in some embodiments, as compared to uniformly scaled arrays.

As will be described further herein, the values of the wavelength scale parameter can correspond to the positions of the antennas along with the frequency of the band. In a Cartesian coordinate system, the value of the wavelength scale parameter can be a function of x, y, and frequency, where the ESA 100 is configured as a planar array, and x- and y-refer to Cartesian coordinate dimensions. In a three-dimensional coordinate system, such as where the ESA 100 is configured as a three-dimensional array—such as a conformal array configured to conform to a three-dimensional surface of an airborne platform or other platform—the value of the wavelength scale parameter can be a function of x, y, z, and frequency (or may be similarly determined in spherical or cylindrical coordinates as appropriate to the application). The ESA 100 can optimize amplitude and phase excitations for non-uniform lattice spacing to achieve desired far field synthesis. The wavelength scale parameter can be used to define a position of each antenna relative to a reference point, such as a center of the ESA 100, or a peripheral point.

In some embodiments, the wavelength scale parameter is defined based on the following functions:

$$d_i = a * d_{i-1}$$

$$d_i \leq \frac{c}{2 * f_i}$$

where c is the speed of light and $f_i$ is the frequency (e.g., design frequency) for the ith antenna band. For example, antennas within band 1 may be spaced from one another by $d_1$ (where $d_1$ is inversely proportional to the design frequency for band 1 as indicated above), antennas within band 2 may be spaced from one another by $d_2$ (where $d_2$ is inversely proportional to the design frequency for band 2 as indicated above), and antennas within band 2 adjacent to antennas within band 1 may be spaced from the adjacent antennas by $d_2$. In some embodiments, a rectangular element position for the ith antenna band may be defined as follows (n and m being element indices in the x and y directions, respectively):

$$x_n = x_{n-1} \pm d_i$$

$$y_m = y_{m-1} \pm d_i$$

and for various radial geometries (e.g., ESAs 800, 900 described below):

$$r_n = r_{n-1} \pm d_i$$

$$Ø_n = Ø_{n-1} \pm f(Ø, i)$$

where n=1 . . . N and N is the number of elements extending outward in each radial path (e.g., paths along axes 806 of ESA 800; paths along curved arcs 906 of ESA 900).

As shown in FIG. 1, at least a second subset of the plurality of second antennas 108 is adjacent to at least a first subset of the plurality of first antennas 104. For example, as illustrated in FIG. 1, each second antenna 108 is adjacent to the twelve outer antennas 104 of the plurality of first antennas 104 (but not the four inner antennas 104). The second subset of the plurality of second antennas 108 can be spaced from corresponding first antennas 104 of the first subset based on a wavelength scale parameter.

The wavelength scale parameter can correspond to a relationship between the highest frequency of operation of adjacent bands of antennas of the ESA 100. For example, the wavelength scale parameter can correspond to a ratio of the second frequency (the highest frequency of operation of the first band 102) to the third frequency (the highest frequency of operation of the second band 106). As such, the spacing represented by the wavelength scale parameter can correspond to the frequencies of operation of each band of the ESA 100. The size of each of the antennas of the ESA 100 may scale with the wavelength scale parameter.

The ESA 100 can receive a command indicating a frequency for transmission (and/or reception) and control operation of the bands 102, 106 to transmit (and/or receive) at the indicated frequency in response to receiving the command. For example, if the indicated frequency is greater than or equal to the first frequency and less than or equal to the second frequency, the ESA 100 can cause the plurality of first antennas 104 of the first band 102 and the plurality of second antennas 108 of the second band 106 to transmit (and/or receive) at the indicated frequency. If the indicated frequency is greater than the second frequency and less than or equal to the third frequency, the ESA 100 can cause the plurality of first antennas 104 to transmit (and/or receive) at the indicated frequency while not causing the plurality of second antennas 108 to transmit (and/or receive) at the indicated frequency.

Figure 2:
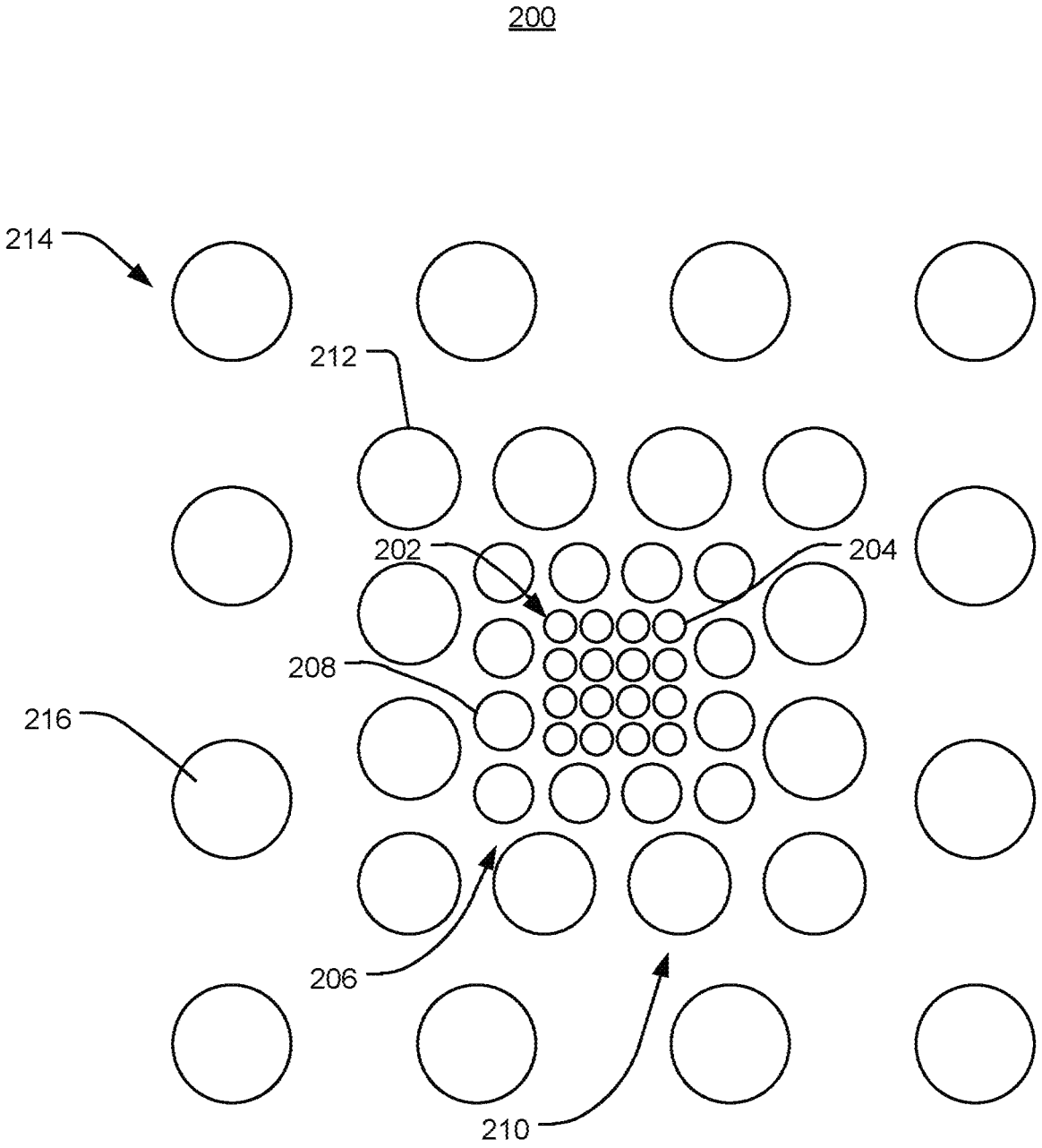
FIG. 2 is a schematic diagram of an exemplary embodiment of a rectangular ESA having four bands according to the inventive concepts disclosed herein.

Referring now to FIG. 2, an embodiment of an ESA 200 according to the inventive concepts disclosed herein includes a first band 202 including a plurality of first antennas 204, a second band 206 including a plurality of second antennas 208, a third band 210 including a plurality of third antennas 212, and a fourth band 214 including a plurality of fourth antennas 216. The ESA 200 is similar to and incorporates features of the ESA 100, except that the ESA 200 includes four bands of antennas.

Similar to the ESA 100, the wavelength scale parameter for the ESA 200 is a continuous scale parameter (e.g., a constant value). The first band 202 is configured to operate from a first frequency to a fifth frequency (the fifth frequency being the highest frequency of operation of the ESA 200). The second band 206 is configured to operate from the first frequency to a fourth frequency, where a ratio of the fifth frequency to the fourth frequency equals the continuous scale parameter. The third band 210 is configured to operate from the first frequency to a third frequency, where a ratio of the fourth frequency to the third frequency is equal to the continuous scale parameter. The fourth band 214 is configured to operate from the first frequency to a second frequency, where a ratio of the third frequency to the second frequency (and of the second frequency to the first frequency) is equal to the continuous scale parameter. In some embodiments, the ESA 200 operates at discrete frequencies corresponding to the first, second, third, and fourth frequencies. It will be appreciated that it can be difficult to provide more than two bands for the ESA 200 without effectively determining the operating frequencies as described herein, particularly for effectively controlling the antennas. At the same time, the ESA 200 can have better performance by providing smoother transitions between band frequencies.

Figure 3:
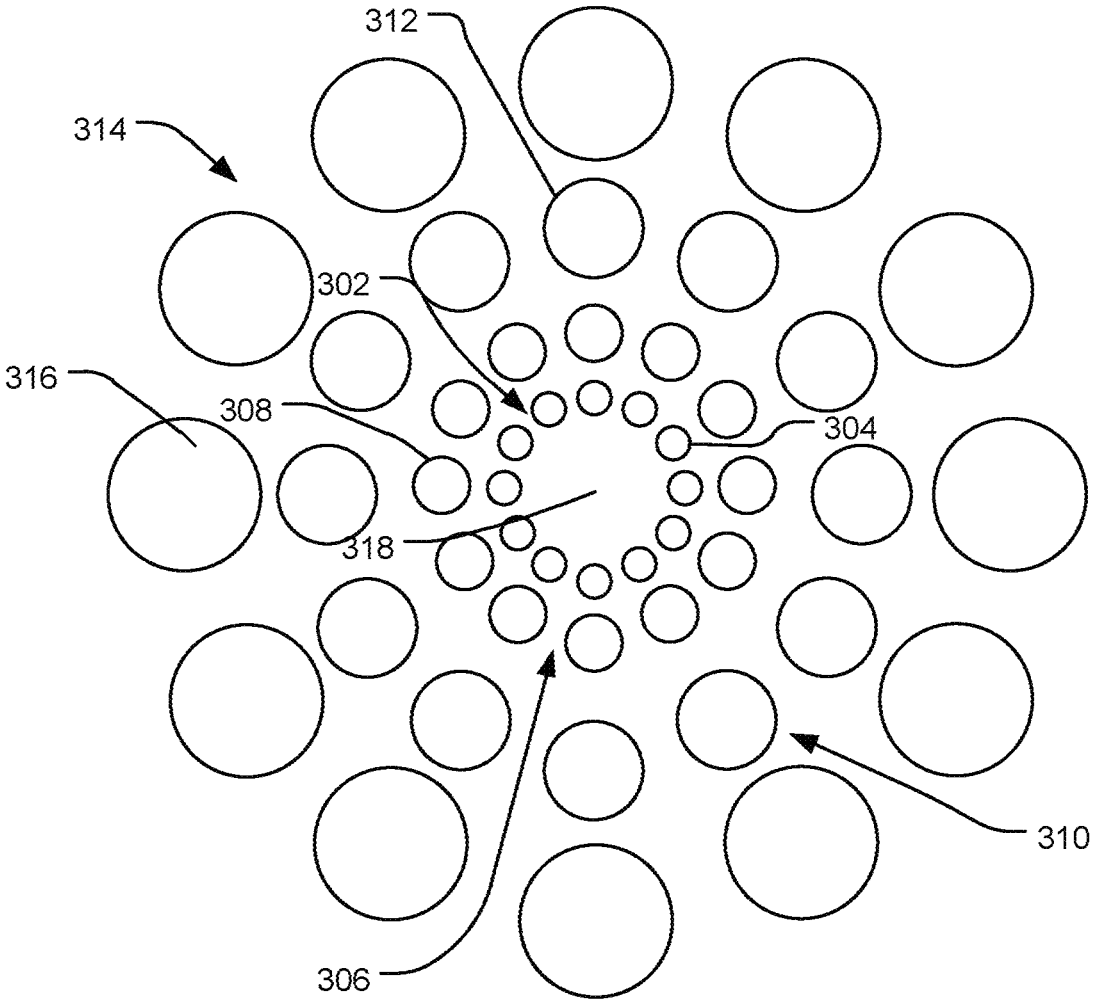
FIG. 3 is a schematic diagram of an exemplary embodiment of a circular ESA according to the inventive concepts disclosed herein.

Referring now to FIG. 3, an ESA 300 is shown according to an embodiment of the inventive concepts disclosed herein. The ESA 300 can incorporate features of the ESAs 100, 200, except that the ESA 300 includes bands of antennas in a circular configuration. As shown in FIG. 3, the ESA 300 includes a first band 302 including a plurality of first antennas 304, a second band 306 including a plurality of second antennas 308, a third band 310 including a plurality of third antennas 312, and a fourth band 314 including a plurality of fourth antennas 316. The ESA 300 may have a circular configuration such that each antenna of each band is equidistant by a radial distance from a center 318 of the ESA 300. The wavelength scale parameter for the ESA 300 as illustrated in FIG. 3 is a continuous scale parameter, though other wavelength scale parameters may also be used; for example, the wavelength scale parameter may be a log scale parameter as described below with reference to FIGS. 5-7. While the ESA 300 is illustrated as having a circular configuration, it will be appreciated that the ESA 300 may have an elliptical configuration (e.g., each antenna is positioned such that each sum of distances from each antenna to two focal points is approximately equal (e.g., within a threshold percentage, such as five percent)). In some embodiments, the circular configuration may be understood to be an example of an elliptical configuration in which the focal points defining the elliptical configuration coincide.

Figure 4B:
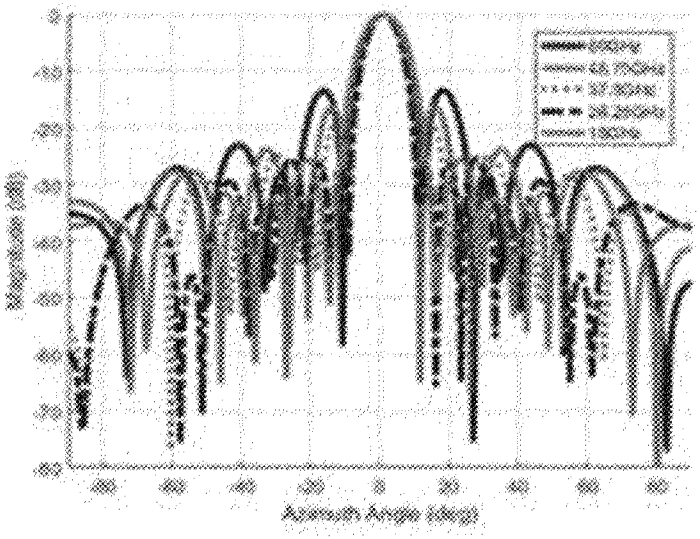
FIGS. 4A-4B are charts of radiation patterns of the circular ESA of FIG. 4.
Figure 4A:
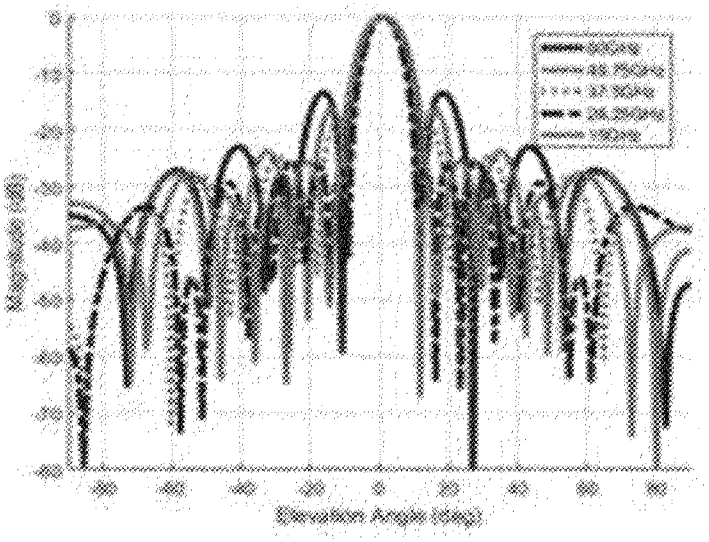

Referring now to FIGS. 4A-4B, charts 400*a*, 400*b* illustrate performance characteristics of the ESA 300 according to an embodiment of the inventive concepts disclosed herein. Chart 400*a* illustrates signal magnitude as a function of elevation angle for each of the five operating frequencies of the ESA 300, indicating consistent magnitude as a function of elevation angle. Similarly, chart 400*b* illustrates consistent signal magnitude as a function of azimuth angle.

Figure 5:
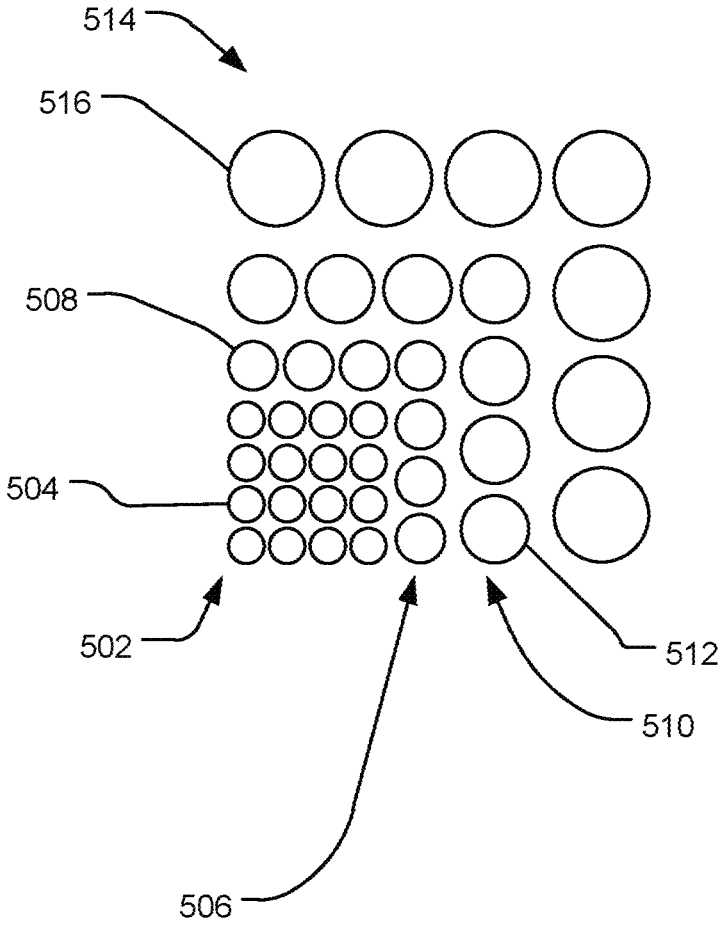
FIG. 5 is a schematic diagram of an exemplary embodiment of a log periodic ESA according to the inventive concepts disclosed herein.

Referring now to FIG. 5, an ESA 500 is shown according to an embodiment of the present disclosure. The ESA 500 can incorporate features of the ESAs 100, 200, 300 described herein, except that the ESA 500 is configured with a log periodically scaled expanding geometry. As shown in FIG. 5, the ESA 500 includes a first band 502 including a plurality of first antennas 504, a second band 506 including a plurality of second antennas 508, a third band 510 including a plurality of third antennas 512, and a fourth band 514 including a plurality of fourth antennas 516. In the illustrated embodiment of FIG. 5, the second antennas 508 of the second band 506 are adjacent to two sides of the array of the plurality of first antennas 504 (and the bands 510, 514 similarly expand from the second band 506). The wavelength scale parameter for the ESA 500 is a log scale parameter, such that values of the log scale parameter vary as a function of an index of each band of the ESA 500, and the variation is based on a logarithm function. For example, the ESA 500 may be configured with a log scale parameter $\tau$ such that $f_{n-1}=f_n/\tau_{n-1}$, where n=1, 2, . . . 4 for the ESA 500, and $\tau$ is less than 1. The bands 504, 506, 508, 510 can each have a half-wavelength spacing between antennas, as the frequency of operation of each band changes based on $\tau$.

Figure 6A:
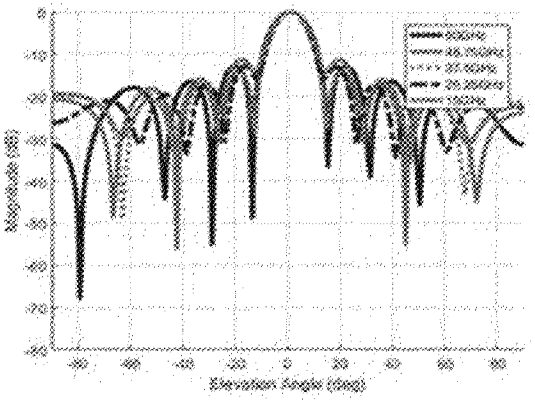
FIGS. 6A-6B are charts of radiation patterns of the log periodic ESA of FIG. 5.
Figure 6B:
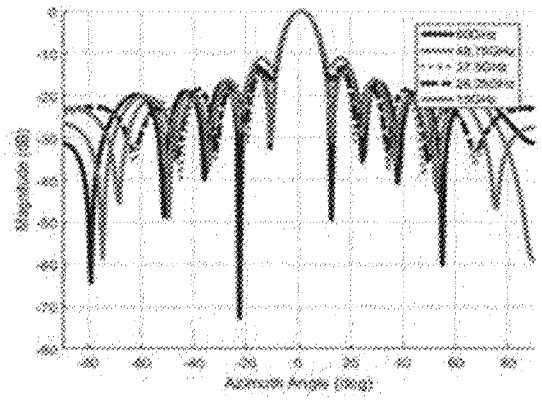

Referring now to FIGS. 6A-6B, charts 600*a*, 600*b* illustrate performance characteristics of the ESA 500 according to an embodiment of the inventive concepts disclosed herein. Similarly to charts 400*a*, 400*b*, charts 600*a*, 600*b* illustrate consistent signal magnitude as a function of both elevation angle (chart 600*a*) and azimuth angle (chart 600*b*) for the ESA 500.

Figure 7:
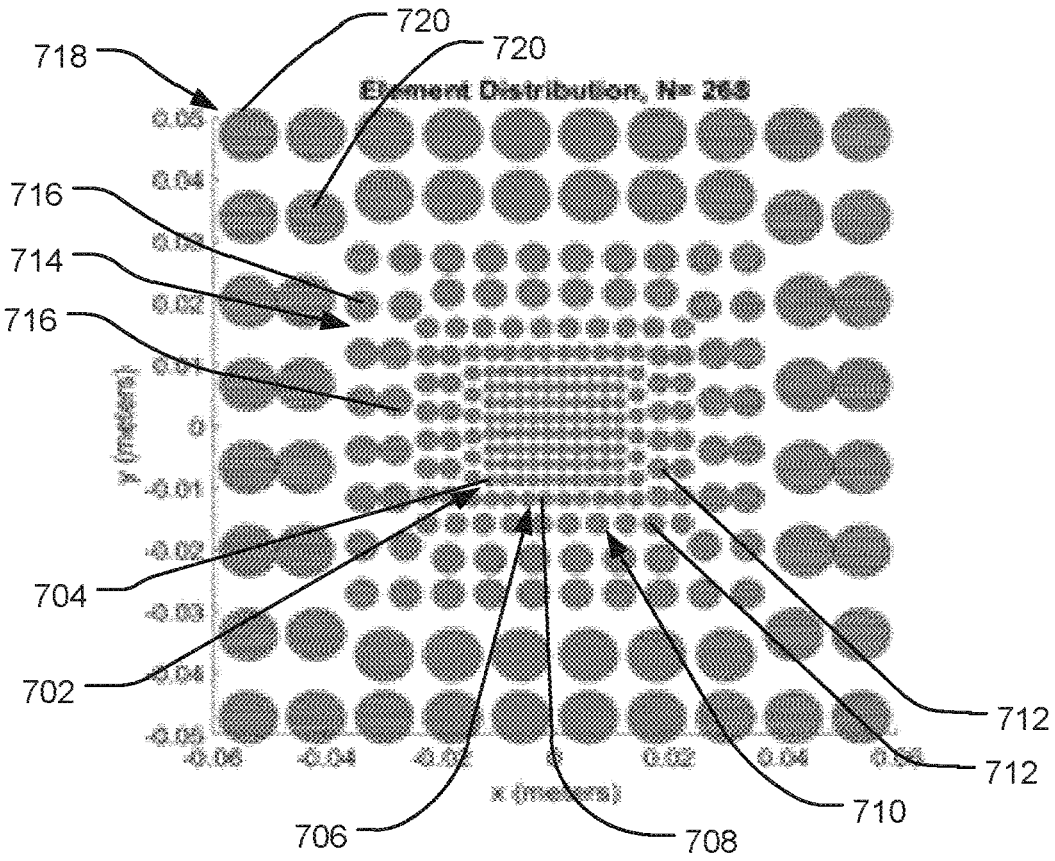
FIG. 7 is a schematic diagram of a centered log periodic ESA according to the inventive concepts disclosed herein.

Referring now to FIG. 7, an ESA 700 is shown according to an embodiment of the present disclosure. The ESA 700 can incorporate features of the ESAs 100, 200, 300, 500 described herein, except that the ESA 700 is configured with a centered log periodically expanding geometry. For example, among each pair of bands of antennas of the ESA 700, the outer band surrounds the inner band. As shown in FIG. 7, the ESA 700 includes a first band 702 including a plurality of first antennas 704, a second band 706 including a plurality of second antennas 708, a third band 710 including a plurality of third antennas 712, a fourth band 714 including a plurality of fourth antennas 716, and a fifth band 718 including a plurality of fifth antennas 720. Each band may include multiple sub-bands of antennas (see, e.g., sub-bands of antennas 712, 716, 720). The ESA 700 has a wavelength scale parameter that is a log scale parameter. The ESA 700 can have advantageous performance due to the quadrant symmetry.

Figure 8:
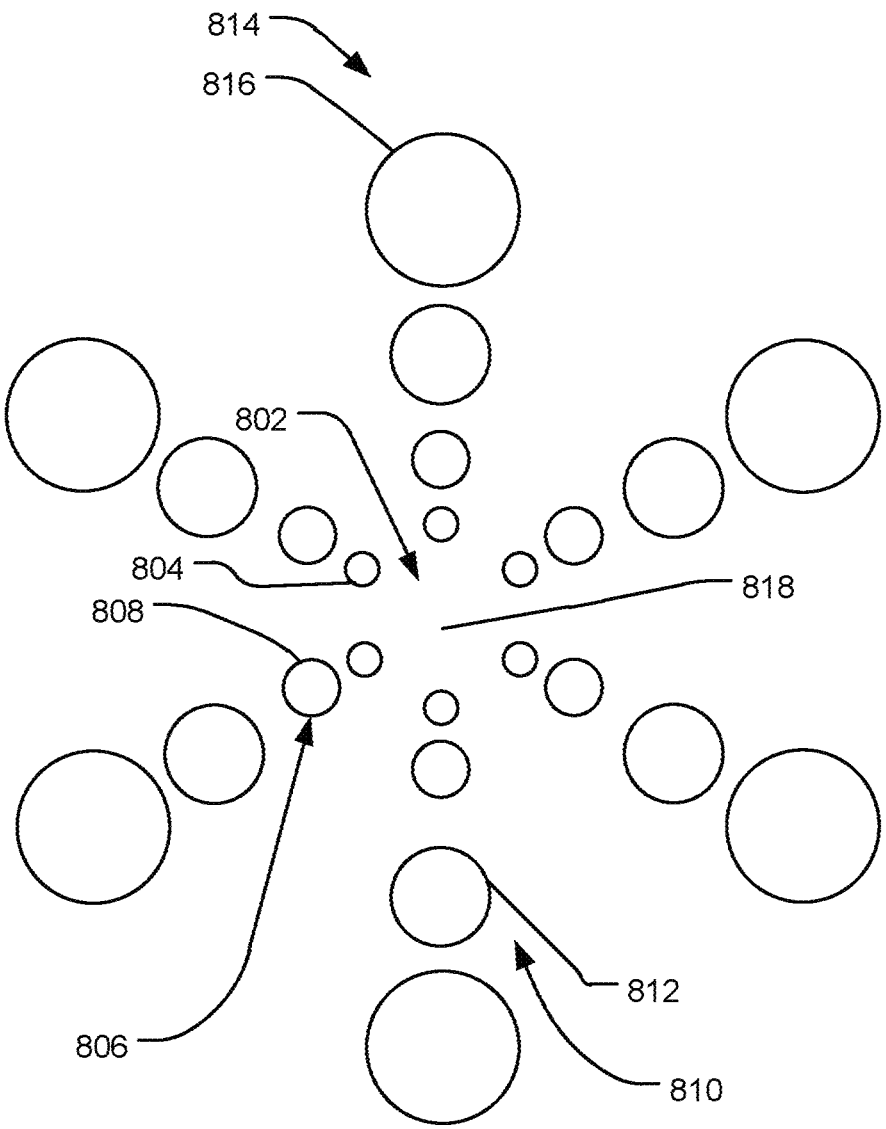
FIG. 8 is a schematic diagram of an ESA having radially expanding bands of antennas according to the inventive concepts disclosed herein.

Referring now to FIG. 8, an ESA 800 is shown according to an embodiment of the present disclosure. The ESA 800 can incorporate features of the ESAs 100, 200, 300, 500, 700. The ESA 800 includes a plurality of bands 802, each band 802 including a plurality of antennas 804. The plurality of bands 802 are arranged to form a plurality of linear paths along a plurality of axes 806. Each axis 806 extends from a center 808 defined by the ESA 800 through one of each of the antennas 804 of the plurality of bands 802. The ESA 800 can incorporate features of some existing arrays, such as the two-dimensional phased arrays described in "Frequency-independent geometry for a two-dimensional phased array" by V. K. Tripp and C. D. Papanicolopoulos. However, unlike such existing two-dimensional phased arrays, such as those that use a different annular ring at each operating frequency, the ESA 800 uses each band 802 having antennas 804 that can operate at or above the particular frequency (e.g., each antenna 804 can have a wide instantaneous bandwidth). For example, to operate at the lowest frequency of operation, the ESA 800 can use every band 802. As such, the ESA 800 can enable constant beamwidths across frequency. As shown in FIG. 8, the ESA 800 has a log scale parameter as the wavelength scale parameter.

Figure 9:
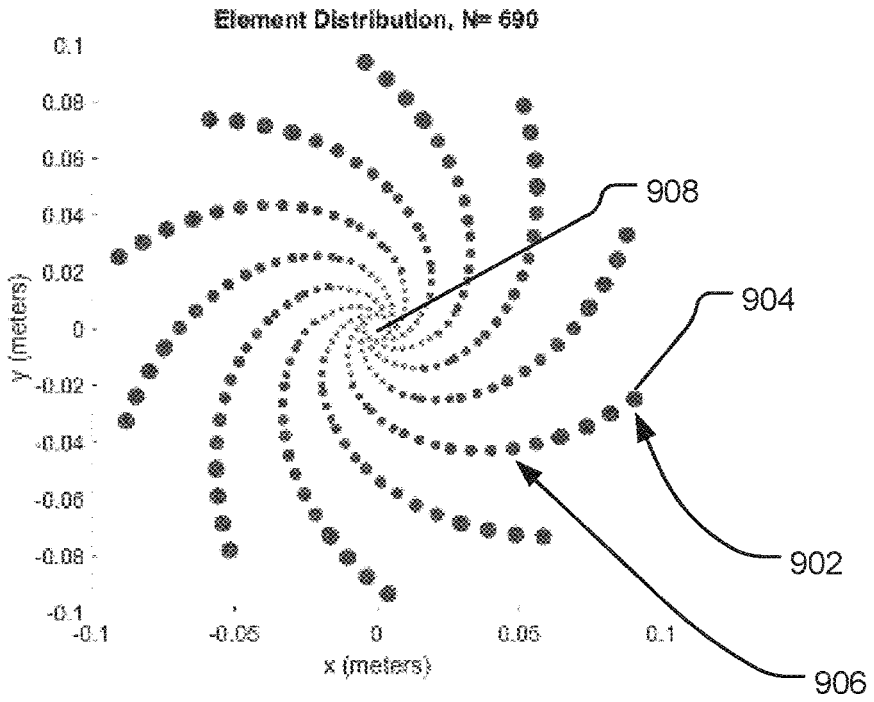
FIG. 9 is a schematic diagram of an ESA having curved radially expanding bands of antennas according to the inventive concepts disclosed herein.

Referring now to FIG. 9, an ESA 900 is shown according to an embodiment of the inventive concepts disclosed herein. The ESA 900 can incorporate features of the ESAs 100, 200, 300, 500, 700, 800. The ESA 900 includes a plurality of bands 902 including antennas 904, and is similar to the ESA 800, except that the plurality of bands 902 are arranged to form a plurality of curved paths along a plurality of curved arcs 906, each arc extending from a center 908 of the ESA 900 (or from a position spaced from the center 908 by a predetermined minimum distance) through the antennas 904 of each curved arc 906. As compared to the ESA 800, the ESA 900 may have relatively higher sidelobe signal magnitude due to the greater spacing (e.g., sparseness) between antennas 904 (relative to antennas 804 of ESA 800). It will be appreciated that the arrangement of antennas 904 of the ESA 900 can also be defined based on a wavelength scale parameter, similar to other ESAs described herein.

In some embodiments, an ESA can be configured in a polygonal or "n-agonal" arrangement (and thus may be similar to the rectangular arrangement of ESA 100 or the arrangement of the ESA 800). For example, the polygonal ESA can be configured in a hexagonal arrangement, though it will be appreciated that other polygonal arrangements, including but not limited to octagonal, nonagonal, and decagonal arrangements may be used as well. The polygonal ESA can be symmetric about a center point. In some embodiments, the polygonal ESA defines a corner aperture. The corner aperture may have a side lobe level less than a threshold side lobe level. In addition, the corner aperture of the polygonal ESA may have an advantageous side lobe position (e.g., placement in a spherical coordinate system based on theta and phi angles).

Figure 10:
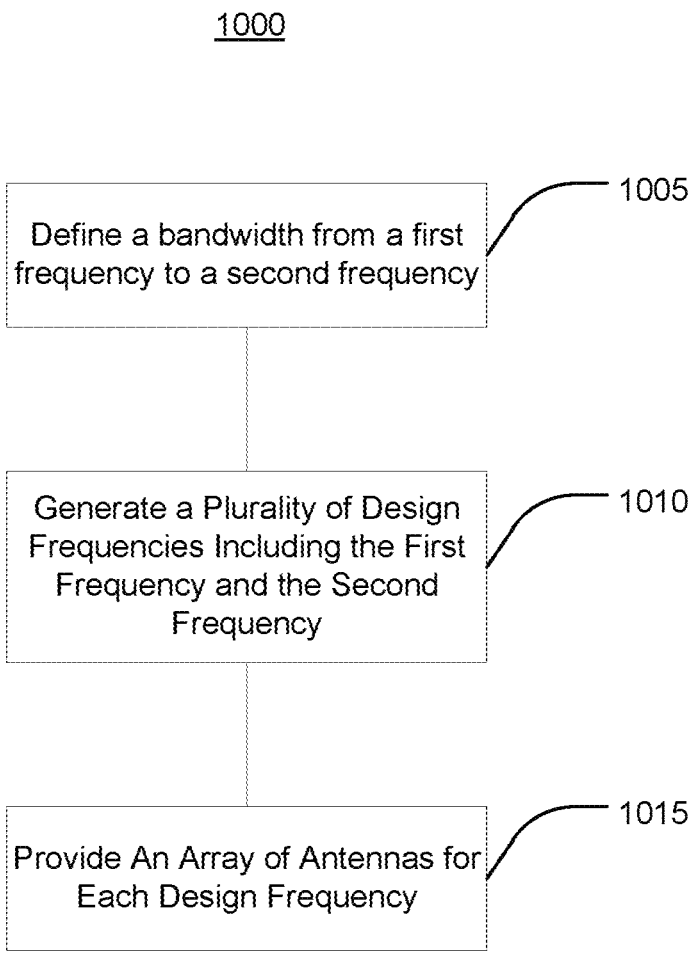
FIG. 10 is a flow diagram of an exemplary embodiment of a method of designing an ESA according to the inventive concepts disclosed herein.

Referring now to FIG. 10, an exemplary embodiment of a method 1000 for designing and/or manufacturing an ESA according to the inventive concepts disclosed herein may include one or more of the following steps. It will be appreciated that the method 1000 may be applied for designing and/or manufacturing various ESAs described herein, including but not limited to the ESAs 100, 200, 300, 500, 700, 800, 900.

A step (1005) may include defining a bandwidth from a first frequency to a second frequency. The first frequency indicates a lowest desired frequency of operation of the ESA, and the second frequency indicates a highest desired frequency of operation of the ESA. In some embodiments, a ratio of the second frequency to the first frequency is at least two to one, such that the ESA can be configured for wideband operation.

A step (1010) may include generating a plurality of design frequencies including the first frequency and the second frequency. In some embodiments, the design frequencies are defined based on a wavelength scale parameter indicating a scaling of the design frequencies. For example, a ratio of each design frequency to at least one of a lower design frequency or a higher design frequency can correspond to the wavelength scale parameter. The first frequency is a lowest frequency of the plurality of design frequencies, and the second frequency is a highest frequency of the plurality of design frequencies. It will be appreciated that for each design frequency other than the lowest frequency or the highest frequency, the ratio of each of such design frequencies to both the next lower and next higher design frequency will be equal to the appropriate wavelength scale parameter. In some embodiments, the wavelength scale parameter is a continuous scale parameter (e.g., a constant, such that the ratio between each pair of adjacent design frequencies is constant). In some embodiments, the wavelength scale parameter may vary as a function of the index of the design frequency. For example, the wavelength scale parameter may be a log scale parameter. The wavelength scale parameter can be determined based on a function of amplitude and delay for a given radiation pattern.

The number of design frequencies may be selected based on expected (e.g., simulated or experimental) performance characteristics of the ESA. For example, generating the plurality of design frequencies can include, for each of a plurality of candidate numbers of design frequencies, determining a corresponding plurality of expected radiation patterns for each design frequency, and identifying the candidate number associated with expected radiation patterns having a highest value of a desired performance characteristic for the ESA. The expected radiation patterns may include at least one of signal magnitude as a function of elevation angle for each design frequency or signal magnitude as a function of azimuth angle for each design frequency.

In some embodiments, the desired performance characteristic includes a consistency of the expected radiation pattern. For example, the consistency may be calculated based on the signal magnitude (as a function of elevation angle and/or azimuth angle) for each design frequency. The consistency may be calculated based on differences in the signal magnitudes (and/or delay/phase) at each elevation angle (and/or azimuth angle) amongst the plurality of design frequencies. Differences at different elevation angles (and/or azimuth angles) may be weighted differently in calculating the consistency, such as based on the position and/or magnitude of selected side lobes. In some embodiments, the desired performance characteristic includes at least one of the position or the magnitude of the side lobe(s).

A step (1015) may include, for each design frequency, providing an array of antennas. The array of antennas is configured to operate at the corresponding design frequency. For example, the array of antennas can transmit and/or receive a radio frequency signal at the corresponding design frequency. In some embodiments, each antenna within each array is spaced from adjacent antennas within the each array by a half wave spacing. In some embodiments, at least two adjacent antennas of each array are spaced from one another by a value of a wavelength scale parameter corresponding to the corresponding design frequency. In some embodiments, each array of antennas has a same number of antennas.

In some embodiments, the arrays of antennas are provided such that at least a subset of each array is spaced by the wavelength scale parameter from at least one of a corresponding subset for a lower design frequency or a higher design frequency. As such, adjacent arrays of antennas may be spaced from one another by the wavelength scale parameter.

In some embodiments, providing the arrays of antennas includes overlaying the arrays of antennas while removing overlapping antennas. Providing the arrays of antennas can include providing, for the first design frequency (the lowest design frequency), a first array of antennas, removing, from the first array of antennas, a group of antennas corresponding to where addition arrays are to be overlaid, and overlaying, on the first array of antennas, a second array of antennas corresponding to the design frequency which is immediately higher than the first design frequency. This process of removing groups of antennas and overlaying additional antennas (e.g., arrays of antennas) may be repeated as additional arrays are desired. As an example, for an ESA with three design frequencies (a first design frequency, a second design frequency that is greater than the first design frequency, and a third design frequency that is greater than the second design frequency) and a rectangular four-by-four arrangement of antennas, providing the arrays of antennas can include: providing a first, four-by-four array of antennas for the first design frequency; removing the inner two-by-two group of antennas from the first array of antennas; providing a second, four-by-four array of antennas for the second design frequency in the space corresponding to the removed inner first antennas; removing the inner two-by-two-group of antennas from the second array of antennas; and providing a third, four-by-four array of antennas for the third design frequency in the space corresponding to the removed inner second antennas.

Providing the arrays of antennas can be performed to make the ESA a rectangular array ESA. For example, providing the arrays of antennas can include providing a first rectangular array corresponding to the first design frequency, and providing a second rectangular array corresponding to the corresponding to the second design frequency. At least a subset of antennas of the second rectangular array can be adjacent to and outward from the first rectangular array.

In some embodiments, providing the array of antennas includes providing a first circular array corresponding to the first design frequency and a second circular array corresponding to the second design frequency. At least a subset of antennas of the second circular array surrounds the first circular array.

In some embodiments, providing the arrays of antennas includes providing at least a first array and a second array forming a plurality of linear paths along a plurality of axes. Each axis extends through a first antenna of the first array, and a second antenna of the second array adjacent to the first antenna.

Providing the arrays of antennas can be performed by providing at least three arrays of antennas corresponding to at least three design frequencies. The first array, second array, and third array can be arranged to form a plurality of curved paths along a plurality of curved arcs. Each arc can extend from a center point through one of the first antennas of the first array, one of the second antennas of the second array, and one of the third antennas of the third array.

In some embodiments, the arrays of antennas are provided to form a three-dimensional array, which can be made conformal to a three-dimensional surface, such as a surface of an airborne platform.

As will be appreciated from the above, ESAs according to embodiments of the inventive concepts disclosed herein may improve upon existing systems by reducing the total number of antenna elements required by not requiring all elements to operate at all frequencies, which can improve manufacturing yield and operational reliability; enabling optimized radiating element and radio frequency hardware implementation across the sub-band regions that make up the wavelength scaled array; and, in some embodiments, removing the constraint of half-wave lattice sampling at the highest operating frequency of the ESA, which can create a significant oversampling disadvantage at lower operating frequencies.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. An electronically scanned antenna array (ESA), comprising:

a first band including a plurality of first antennas, each first antenna configured to operate over a first frequency bandwidth from a first frequency to a second frequency, the first frequency less than the second frequency, at least two adjacent first antennas spaced from one another by a first value of a wavelength scale parameter, the first value corresponding to the second frequency; and a second band including a plurality of second antennas, each second antenna configured to operate over a second frequency bandwidth from the first frequency to a third frequency, the third frequency greater than the first frequency and less than the second frequency, at least two adjacent second antennas spaced from one another by a second value of the wavelength scale parameter, the second value corresponding to the third frequency, wherein at least a second subset of the plurality of second antennas is adjacent to at least a first subset of the plurality of first antennas, the second subset spaced from corresponding first antennas of the first subset based on the wavelength scale parameter;

wherein the first band and second band are arranged to form a plurality of linear paths along a plurality of axes, each axis extending from a center point through one of the first antennas and through one of the second antennas adjacent to the one of the first antennas; and wherein the electronically scanned array is configured to transmit and/or receive signals through the first plurality of antennas and the second plurality of antennas.

2. The ESA of claim 1, wherein the wavelength scale parameter is a log scale parameter or a continuous scale parameter.

3. The ESA of claim 1, wherein the first band forms a first rectangular array, the second band forms a second rectangular array, and the second subset of the plurality of second antennas at least partially surrounds the first band.

4. The ESA of claim 1, wherein the first band forms a first circular array, the second band forms a second circular array, and the second subset of the plurality of second antennas at least partially surrounds the first band.

5. The ESA of claim 1, further comprising a third band including a plurality of third antennas, each third antenna configured to operate over a third frequency bandwidth from the first frequency to a fourth frequency, the fourth frequency greater than the first frequency and less than the third frequency, wherein the first band, second band, and third band are arranged to form a plurality of curved paths along a plurality of curved arcs, each arc extending from a center point through one of the first antennas, through one of the second antennas adjacent to one of the first antennas, and through one of the third antennas adjacent to one of the second antennas.

6. The ESA of claim 1, wherein the first band and second band form a three-dimensional array of antennas configured to conform to a surface of an airborne platform.

7. The ESA of claim 1, wherein the ESA is configured to receive a command to transmit and/or receive at the first frequency, and responsive to receiving the command, use each of the plurality of first antennas and each of the plurality of second antennas to transmit and/or receive at the first frequency.

8. The ESA of claim 1, wherein the first antenna is configured to transmit and/or receive a first radio frequency of the first frequency bandwidth by receiving an indication of a selected frequency greater than or equal to the first frequency and less than or equal to the second frequency, and respectively transmitting or receiving at the selected frequency.

9. The ESA of claim 1, wherein a ratio of the second frequency to the first frequency is at least two to one.

10. The ESA of claim 1, wherein the first band forms a first array, the second band forms a second array, the first array being disposed in a first quadrant of the ESA and the second array being disposed outside the first quadrant.

11. A method of designing and operating an electronically scanned antenna array (ESA), comprising:

defining a bandwidth from a first frequency to a second frequency;

generating a plurality of design frequencies including the first frequency and the second frequency, a ratio of each design frequency to at least one of a lower design frequency or a higher design frequency corresponding to a wavelength scale parameter, wherein generating the plurality of design frequencies includes selecting a number of design frequencies by:

for each of a plurality of candidate numbers of design frequencies, determining a corresponding plurality of expected radiation patterns for each design frequency; and identifying the candidate number associated with expected radiation patterns having a highest consistency;

for each design frequency, providing an array of antennas configured to operate at the corresponding design frequency, wherein each antenna within each array is spaced from adjacent antennas within the each array by a half wave spacing, and at least two adjacent antennas of each array are spaced from one another based on the wavelength scale parameter; and operating the electronically scanned array such that the electronically scanned array transmits and/or receives signals through the first plurality of antennas and the second plurality of antennas.

12. The method of claim 11, wherein the wavelength scale parameter is log scale parameter or a continuous scale parameter.

13. The method of claim 11, wherein each array of antennas has a same number of antennas.

14. The method of claim 11, wherein at least a subset of antennas of each array is spaced by the wavelength scale parameter from at least one of a corresponding subset for a lower design frequency or a corresponding subset of a higher design frequency.

15. The method of claim 11, wherein providing the arrays of antennas includes:

providing, for the first design frequency, a first array of antennas;

removing, from the first array of antennas, a group of antennas corresponding to where additional arrays are to be overlaid; and overlaying, on the first array of antennas, a second array of antennas corresponding to the design frequency which is immediately higher than the first design frequency.

16. The method of claim 11, wherein providing the arrays of antennas includes:

providing a first rectangular array corresponding to the first design frequency; and providing a second rectangular array corresponding to the second design frequency, wherein at least a subset of antennas of the second rectangular array is outward from the first rectangular array.

17. The method of claim 11, wherein providing the arrays of antennas includes:

providing a first circular array corresponding to the first design frequency; and providing a second circular array corresponding to the second design frequency, wherein at least a subset of antennas of the second circular array surrounds the first circular array.

18. The method of claim 11, wherein providing the arrays of antennas includes providing at least a first array and a second array forming a plurality of linear paths along a plurality of axes, each axis extending through a first antenna of the first array and a second antenna of the second array adjacent to the first antenna.

19. The method of claim 11, wherein each array of antennas is provided in a polygonal arrangement, the ESA further defining at least one corner aperture having a side lobe level less than a threshold side lobe level.

20. The method of claim 11, wherein providing the arrays of antennas includes providing at least a first array and a second array, the first array being disposed in a first quadrant of the ESA and the second array being disposed outside the first quadrant.

* * * * *